US008919047B2

(12) United States Patent
Johnsrud et al.

(10) Patent No.: US 8,919,047 B2
(45) Date of Patent: Dec. 30, 2014

(54) NORMALLY DEPLOYING FLUSH DOOR HANDLE

(75) Inventors: Kevin Johnsrud, Yardley, PA (US); William A. Kokemor, Chalfont, PA (US); Andrew Ondo, Sharpsville, PA (US); Tony Trinh, Willow Grove, PA (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/585,877

(22) Filed: Aug. 15, 2012

(65) Prior Publication Data

US 2014/0047773 A1 Feb. 20, 2014

(51) Int. Cl.
*E06B 3/00* (2006.01)

(52) U.S. Cl.
USPC ..... 49/503; 292/336.3

(58) Field of Classification Search
USPC ..... 49/460, 503; 16/113.1, 429, 405; 292/336.3, DIG. 31
See application file for complete search history.

(56) References Cited

U.S. PATENT DOCUMENTS 3,447,197 A * 6/1969 Szabo ..... 16/405
5,560,458 A * 10/1996 Franklin et al. ..... 190/115
5,600,920 A * 2/1997 Roy ..... 49/64
5,904,385 A * 5/1999 Linder ..... 292/336.3
6,530,251 B1 * 3/2003 Dimig ..... 70/237
7,145,436 B2 * 12/2006 Ichikawa et al. ..... 340/5.72
8,443,553 B1 * 5/2013 Polewarczyk et al. ..... 49/503
8,453,297 B2 * 6/2013 Wang ..... 16/114.1
8,701,353 B2 * 4/2014 Patel et al. ..... 49/503
2004/0031301 A1 * 2/2004 Dominique ..... 70/237
2008/0163555 A1 * 7/2008 Thomas et al. ..... 49/460
2009/0079233 A1 * 3/2009 Hidaka et al. ..... 296/210
2012/0268873 A1 * 10/2012 Nakatani et al. ..... 361/679.01
2012/0291359 A1 * 11/2012 Hans et al. ..... 49/449
2013/0127185 A1 * 5/2013 Lang et al. ..... 292/336.3

* cited by examiner

*Primary Examiner* — Katherine Mitchell
*Assistant Examiner* — Catherine A Kelly
(74) *Attorney, Agent, or Firm* — Quinn Law Group, PLLC

(57) ABSTRACT

A handle assembly for a door of a vehicle includes a housing, and a grab bar moveably supported by the housing. The grab bar is linearly moveable along a linear path between a retracted position and an extended position. The linear path is disposed on a plane. A motor is attached to the housing, and includes an output rotatable about a rotation axis. The rotation axis is perpendicular to the plane. A scotch yoke mechanism interconnects the output of the motor and the grab bar. The scotch yoke mechanism translates rotational movement of the output into the linear movement of the grab bar to move the grab bar between the extended position and the retracted position.

11 Claims, 3 Drawing Sheets

NORMALLY DEPLOYING FLUSH DOOR HANDLE

TECHNICAL FIELD

The invention generally relates to a handle assembly for a door of a vehicle.

BACKGROUND

Vehicle doors include an exterior handle assembly for opening and closing the door. The handle assembly may be designed to extend outboard of an exterior panel surface of the door to allow an operator to grasp the handle assembly. Alternatively, the exterior panel surface of the door may define an inward recess to allow the operator to grasp the handle assembly. Furthermore, vehicle styling may require that an outboard surface of the handle assembly be positioned approximately flush with the exterior panel surface of the door when not in use. When needed to open the door, the flush mounted handle assembly may deploy out through a swing or pivot motion relative to the exterior panel surface of the door, or may alternatively deploy out in a normal direction relative to the exterior panel surface of the door, thereby allowing the operator to grasp the handle assembly.

SUMMARY

A door assembly is provided. The door assembly includes a structure having an exterior panel surface. A handle assembly is coupled to the structure. The handle assembly includes a grab bar having an outboard surface. The grab bar is linearly moveable relative to the exterior panel surface of the structure between a retracted position and an extended position. When the handle assembly is disposed in the refracted position, the grab bar is positioned with the outboard surface of the grab bar approximately flush with the exterior panel surface of the structure. When the handle assembly is disposed in the extended position, the grab bar is laterally spaced outboard of the exterior panel surface of the structure. The handle assembly includes a motor having an output that is rotatable about a rotation axis. A yoke mechanism interconnects the output of the motor and the grab bar. The yoke mechanism translates rotational movement of the output into the linear movement of the grab bar to move the grab bar between the extended position and the retracted position.

A handle assembly for a door of a vehicle is also provided. The handle assembly includes a housing, and a grab bar moveably supported by the housing. The grab bar is linearly moveable along a linear path between a retracted position and an extended position. The linear path is disposed on a plane. A motor is attached to the housing, and includes an output rotatable about a rotation axis. The rotation axis is perpendicular to the plane. A yoke mechanism interconnects the output of the motor and the grab bar. The yoke mechanism translates rotational movement of the output into the linear movement of the grab bar to move the grab bar between the extended position and the retracted position.

Accordingly, the grab bar of the handle assembly moves in a normal direction relative to the exterior panel surface of the door, between the retracted position in which the outboard surface of the grab bar is approximately flush with the exterior panel surface, and the extended position in which the grab bar is spaced from the exterior panel surface to allow the operator to grasp the grab bar. The position of the grab bar when in the retracted position, approximately flush with the exterior panel surface of the structure, in combination with the movement of the grab bar in the normal direction relative to the exterior panel surface, provides a pleasing style feature to the door assembly. The yoke mechanism provides a simple and cost effective mechanism to convert rotational movement of the motor into linear movement of the grab bar.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Referring to the Figures, wherein like numerals indicate like parts throughout the several views, a door assembly is generally shown at 20. The door assembly 20 may be configured for use as a side door of a vehicle, a rear cargo door of a vehicle, or some other vehicular closure. Furthermore, it should be appreciated that the door assembly 20 may be configured for some other use not associated with a vehicle, such as but not limited to a cabinet door.

Figure 1:
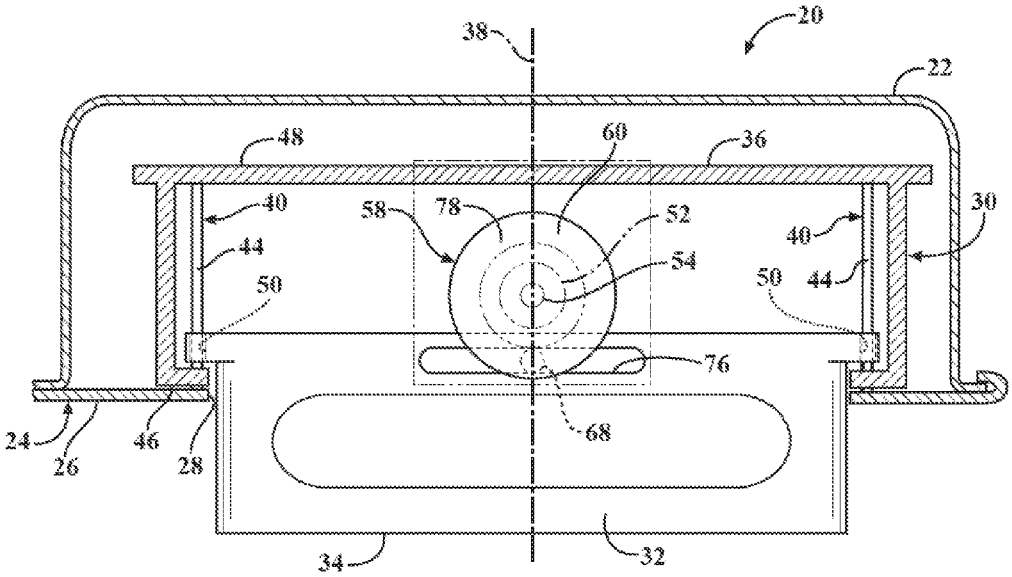
FIG. 1 is a schematic fragmentary plan view a door assembly showing a grab bar of a handle assembly in an extended position.
Figure 2:
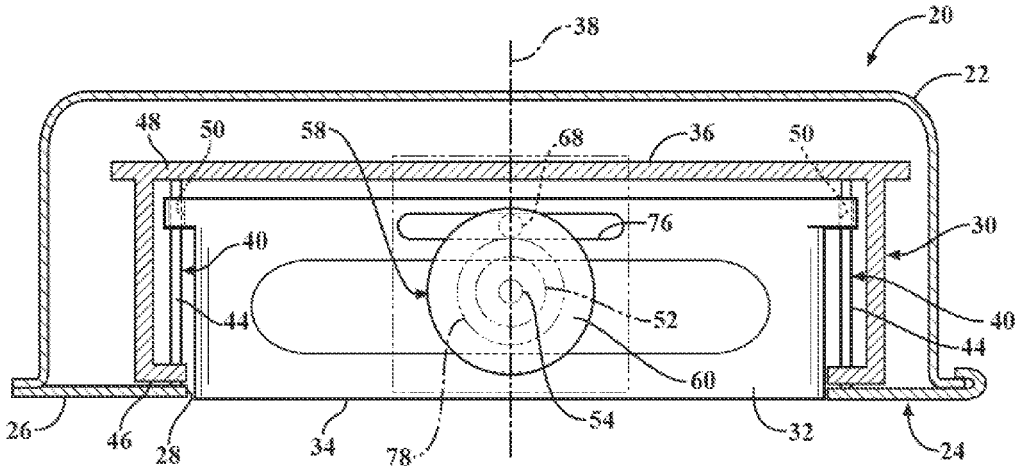
FIG. 2 is a schematic fragmentary plan view of the handle assembly showing the grab bar in a retracted position.

Referring to FIGS. 1 and 2, the door assembly 20 includes a structure 22. The structure 22 includes a panel 24 defining an exterior panel surface 26, and all braces, supports, etc. necessary to support the panel 24 and the various components of the door assembly 20, and to attach the door assembly 20 to the vehicle. The exterior panel surface 26 is disposed on an outboard side of the panel 24. As used herein, the term "outboard" refers to a location relative to a center of the vehicle that is located further away from an "inboard" location. As such, an inboard location is disposed nearer the center of the vehicle relative to an outboard location, which is disposed farther from the center of the vehicle.

Figure 3:
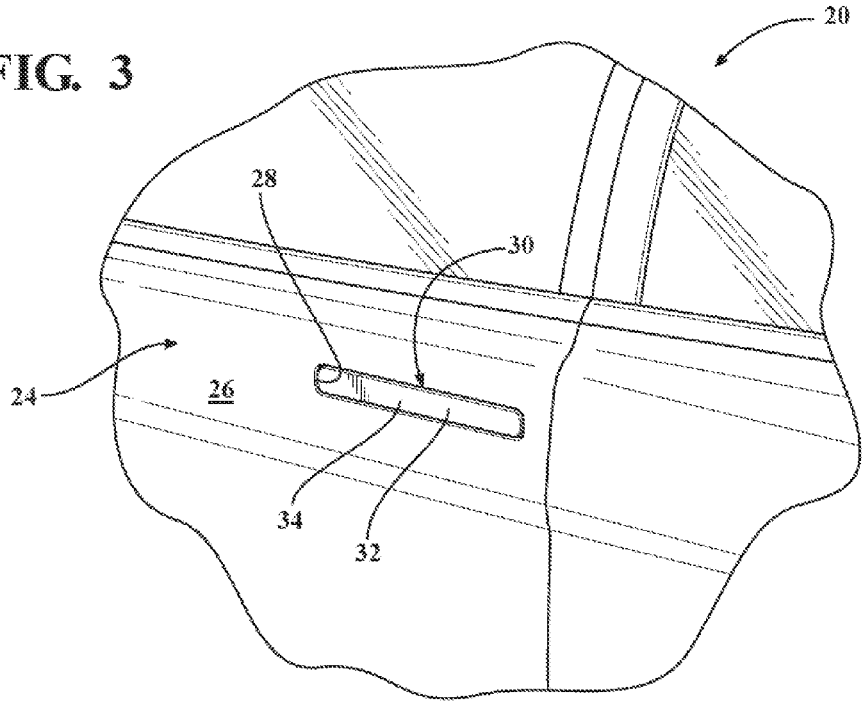
FIG. 3 is a schematic perspective view of the door assembly showing the grab bar in the retracted position.
Figure 4:
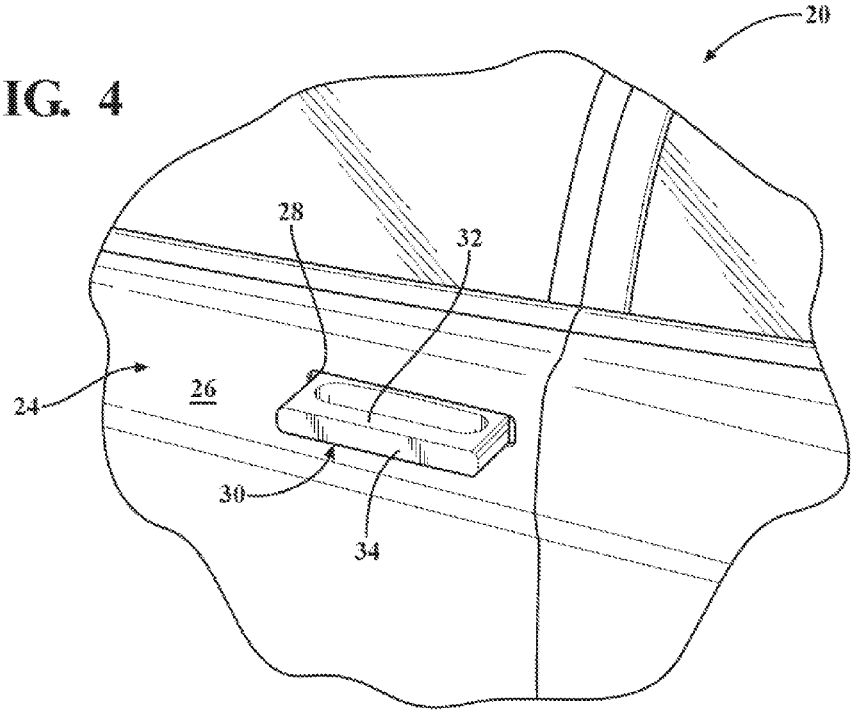
FIG. 4 is a schematic perspective view of the door assembly showing the grab bar in the extended position.

Referring also to FIGS. 3 and 4, the exterior panel surface 26 defines an opening 28 extending therethrough. The door assembly 20 further includes a handle assembly 30. The handle assembly 30 is coupled to the structure 22, and includes a grab bar 32. The grab bar 32 is moveable relative to the exterior panel surface 26 of the structure 22 between a retracted position, shown in FIGS. 1 and 3, and an extended position, shown in FIGS. 2 and 4. As shown, the grab bar 32 moves in a linear, normal direction relative to the exterior panel surface 26. However, the grab bar 32 may alternatively be configured to move in a non-normal direction relative to the exterior panel surface 26. As used herein, the term "normal direction" refers to movement in a direction that is substantially perpendicular to a surface without pivotal and/or rotational movement relative to the surface. It should be appreciated that the exterior panel surface 26 of the door assembly 20 may include a three dimensional shape that is not perfectly planar. Accordingly, it should be appreciated that the grab bar 32 may move in a direction that is not exactly perpendicular, i.e., not exactly ninety degrees relative to the exterior panel surface 26. However, the grab bar 32 moves relative to the exterior panel surface 26 without rotating and/or pivoting relative to the exterior panel surface 26. Furthermore, it should be appreciated that the movement of the grab bar 32 is normal to the exterior panel surface 26, regardless of the orientation of the exterior panel surface 26 relative to a ground surface. Accordingly, the movement of the grab bar 32 relative to the exterior panel surface 26 may be in a vertical direction relative to the ground, in a horizontal direction relative to the ground, or at any angle therebetween.

The grab bar 32 includes an outboard surface 34, and is positioned within the opening 28 when in the retracted position, with the outboard surface 34 of the grab bar 32 approximately flush with the exterior panel surface 26 of the structure 22. As used herein, the term "approximately flush" is defined to include surfaces that are substantially disposed on the same plane, but that may include minor feature differences, such as a surface curvature or design accent, that slightly deviate from the shared plane. The grab bar 32 is laterally spaced outboard of the exterior panel surface 26 of the structure 22 when the grab bar 32 is in the extended position, thereby allowing an operator to grasp the grab bar 32. The grab bar 32 and the opening 28 are sized and shaped to match each other so that the grab bar 32 fits neatly within the opening 28 when in the retracted position, presenting a continuous exterior surface of the door assembly 20. The grab bar 32 and the opening 28 may each include a complimentary shape and/or configuration deemed appropriate to meet the design and styling requirements of the door assembly 20.

Figure 5:
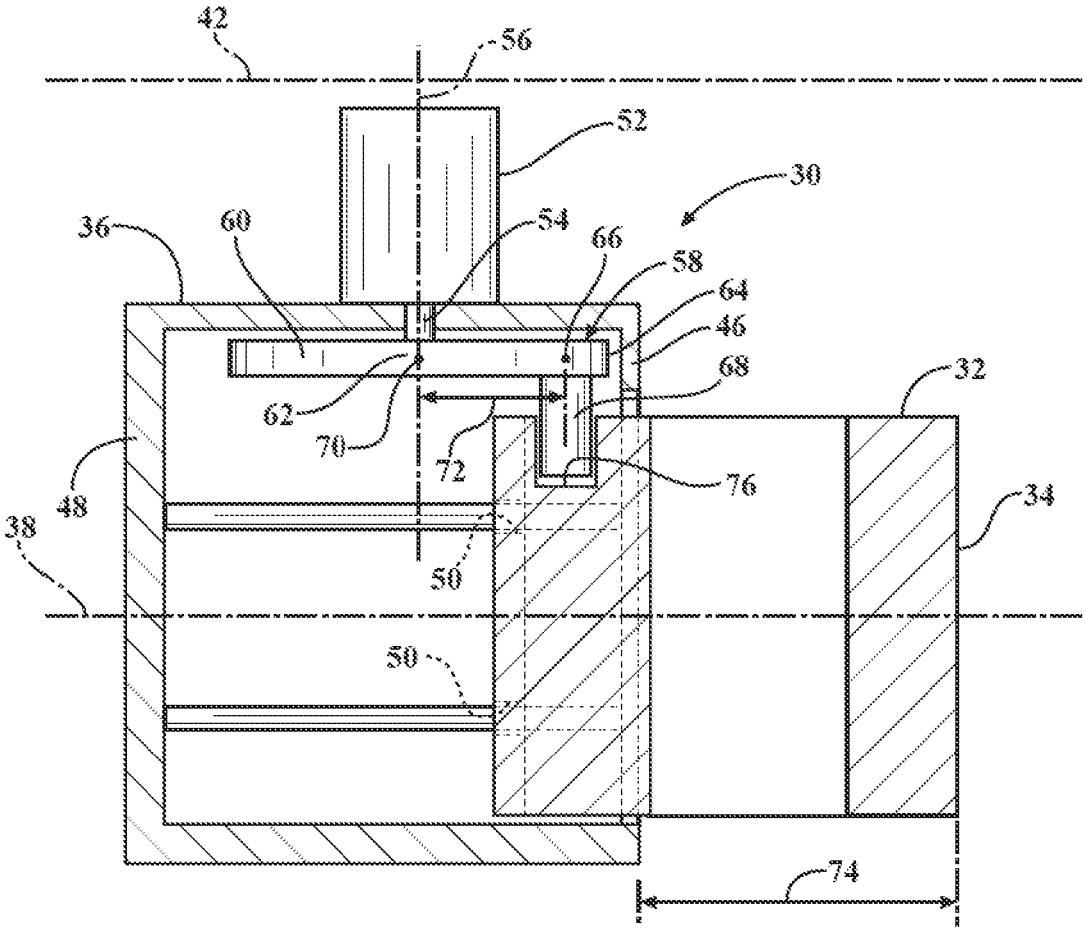
FIG. 5 is a schematic cross sectional view of the handle assembly.

Referring to FIGS. 1, 2 and 5, the handle assembly 30 includes a housing 36 moveably supporting the grab bar 32. The housing 36 may be shaped and/or configured in any suitable manner to slideably support the grab bar 32 and secure the grab bar 32 relative to the structure 22. As best shown in FIG. 5, the grab bar 32 moves along a linear path 38. The housing 36 includes at least one guide member 40 that engages the grab bar 32 to guide the grab bar 32 along the linear path 38. The linear path 38 is disposed parallel to a plane 42 (shown only in FIG. 5 as a line disposed perpendicular with the page) on which the grab bar 32 is substantially aligned. The guide member 40 may be configured in any suitable manner. For example, the housing 36 may include a pair of posts 44 disposed at each edge of the grab bar 32 (only one pair of posts 44 is shown). The posts 44 extend parallel with a direction of travel of the grab bar 32 between an outboard wall 46 of the housing 36 and an inboard wall 48 of the housing 36. The grab bar 32 defines apertures 50 that slideably receive the posts 44 therethrough. The sliding interaction between the apertures 50 and the posts 44 guide the grab bar 32 along the linear path 38 of the grab bar 32. It should be appreciated that the guide member 40 may be configured in some manner other than described herein and shown in the Figures A motor 52 is attached to the housing 36. The motor 52 includes an output 54 (shown only in FIG. 5), such as a shaft, that is rotatable about a rotation axis 56. The rotation axis 56 of the output 54 is disposed perpendicular to the plane 42. When actuated, the motor 52 rotates the output 54 about the rotation axis 56. The motor 52 may be actuated in any suitable manner, such as through an electrical signal from a control module. The motor 52 may include a stepper motor that divides a full rotation into a number of equal steps. Preferably, the motor 52 includes an electric motor 52. However, it should be appreciated that the motor 52 may include some other style of motor not described herein that is capable of generating a torque to rotate the output 54.

A yoke mechanism 58 interconnects the output 54 of the motor 52 and the grab bar 32. The yoke mechanism 58 translates rotational movement of the output 54 into the linear movement of the grab bar 32 to move the grab bar 32 along the linear path 38 between the extended position and the retracted position. The yoke mechanism 58 may include, but is not limited to, a scotch yoke, which converts rotational movement into linear movement. More specifically, the yoke mechanism 58 includes an arm 60 having a first end 62 and a second end 64. As shown in FIG. 5, the first end 62 is attached to the output 54 of the motor 52 at a first connection location 66. A pin 68 is attached to the second end 64 of the arm 60 at a second connection location 70. The first connection point and the second connection point define a radial distance 72 therebetween. The radial distance 72 is equal to one half (½) a travel distance 74 that the grab bar 32 moves along the linear path 38 between the retracted position and the extended position. Accordingly, twice the radial distance 72 is equal to the travel distance 74. As shown, the arm 60 includes an annular disk, with the first connection location 66 disposed at a diametric center of the annular disk. However, it should be appreciated that the arm 60 may be configured to include some other shape, such as an elongated bar shape or the like.

The grab bar 32 defines a linear slot 76. The linear slot 76 is disposed parallel with the plane 42, and perpendicular to the linear path 38 of the grab bar 32. The pin 68 is moveably disposed within the linear slot 76. Rotation of the arm 60 about the rotation axis 56 moves the pin 68 along an arcuate path 78, shown in FIGS. 1 and 2. Movement of the pin 68 along the arcuate path 78 causes the pin 68 to slide within the linear slot 76, and moves the grab bar 32 along the linear path 38. It should be appreciated that the arm 60 rotates one hundred eighty degrees (180°) about the rotation axis 56 when moving the grab bar 32 from the retracted position into the extended position, or from the extended position into the retracted position. As such, the arm 60 may rotate in a continuous direction to move the grab bar 32 back and forth along the linear path 38, between the extended position and the retracted position. Alternatively, the motor 52 may be configured to alternate rotational directions when extending and retracting the grab bar 32.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A door assembly comprising:

a structure including an exterior panel surface; and a handle assembly coupled to the structure and including a grab bar having an outboard surface;

wherein the handle assembly is linearly moveable relative to the exterior panel surface of the structure between a retracted position and an extended position;

wherein the grab bar is positioned with the outboard surface of the grab bar approximately flush with the exterior panel surface of the structure when the handle assembly is disposed in the retracted position, and wherein the grab bar is laterally spaced outboard of the exterior panel surface of the structure when the handle assembly is disposed in the extended position; and wherein the handle assembly includes:

a motor having an output rotatable about a rotation axis; and a yoke mechanism interconnecting the output of the motor and the grab bar and configured for translating rotational movement of the output into the linear movement of the grab bar to move the grab bar between the extended position and the retracted position.

2. A door assembly as set forth in claim 1 wherein the grab bar moves along a linear path disposed parallel to a plane, with the rotation axis of the output disposed perpendicular to the plane.

3. A door assembly as set forth in claim 2 wherein the yoke mechanism includes an arm having a first end attached to the output of the motor at a first connection location, and a second end having a pin attached to the arm at a second connection location.

4. A door assembly as set forth in claim 3 wherein the arm includes an annular disk with the first connection location disposed at a diametric center of the annular disk.

5. A door assembly as set forth in claim 3 wherein the first connection point and the second connection point define a radial distance therebetween, wherein the radial distance is equal to a travel distance of the grab bar between the retracted position and the extended position.

6. A door assembly as set forth in claim 3 wherein the grab bar defines a linear slot disposed parallel with the plane and perpendicular to the linear path of the grab bar.

7. A door assembly as set forth in claim 6 wherein the pin is moveably disposed within the linear slot such that rotation of the arm about the rotation axis moves the pin along an arcuate path, such that the pin slides within the linear slot causing the grab bar to move along the linear path.

8. A door assembly as set forth in claim 1 wherein the handle assembly includes a housing moveably supporting the grab bar.

9. A door assembly as set forth in claim 8 wherein the housing includes at least one guide member engaging the grab bar to guide the grab bar along the linear path.

10. A door assembly as set forth in claim 9 wherein the motor includes an electric motor.

11. A door assembly as set forth in claim 1 wherein the yoke mechanism includes a scotch yoke.

* * * * *